US007996918B2

(12) United States Patent
Bish

(10) Patent No.: US 7,996,918 B2
(45) Date of Patent: Aug. 16, 2011

(54) HAIRCUTTING CAPE WITH FRONT CLOSURE

(76) Inventor: Charity Bish, Salt Lake City, UT (US)

( * ) Notice: Subject to any disclaimer, the term of this patent is extended or adjusted under 35 U.S.C. 154(b) by 0 days.

(21) Appl. No.: 12/703,873

(22) Filed: Feb. 11, 2010

(65) Prior Publication Data

US 2010/0205712 A1 Aug. 19, 2010

Related U.S. Application Data

(60) Provisional application No. 61/152,620, filed on Feb. 13, 2009.

(51) Int. Cl.
*A41D 13/04* (2006.01)

(52) U.S. Cl. ..... 2/50

(58) Field of Classification Search ..... 2/50, 48, 2/88, 104, 49.1, 51, 52, 46, 69.5, 83, 114, 2/92, 91, 207; D2/860, 861, 826, 720, 724, D2/725, 823

See application file for complete search history.

(56) References Cited

U.S. PATENT DOCUMENTS

| | | | | | |
|---|---|---|---|---|---|
| 905,270 | A | * | 12/1908 | Abraham | 2/91 |
| 1,272,942 | A | * | 7/1918 | Goldstein | 2/88 |
| 1,722,067 | A | * | 7/1929 | Vaxes | 2/50 |
| 1,887,028 | A | | 11/1932 | Lemke et al. | |
| 2,016,079 | A | | 10/1935 | Deuel et al. | |
| D119,464 | S | | 3/1940 | Small | |
| 2,417,888 | A | * | 3/1947 | Schuster | 2/104 |
| 2,698,944 | A | * | 1/1955 | Ramsby | 2/174 |
| 2,744,252 | A | | 5/1956 | Cansler | |
| 2,832,075 | A | * | 4/1958 | Davidson | 2/91 |
| 3,031,676 | A | | 5/1962 | Larson | |
| 3,067,428 | A | | 12/1962 | Baker et al. | |
| 4,280,227 | A | | 7/1981 | Brock | |
| 4,571,743 | A | * | 2/1986 | Wagoner | 2/88 |
| 4,615,047 | A | | 10/1986 | Matsuoka | |
| 4,697,287 | A | * | 10/1987 | Rose | 2/48 |
| 4,726,085 | A | | 2/1988 | Antonio | |
| 4,752,971 | A | * | 6/1988 | Meserol | 2/88 |
| 4,771,480 | A | * | 9/1988 | Stimson et al. | 2/88 |

(Continued)

FOREIGN PATENT DOCUMENTS

FR 2685856 A1 7/1993

(Continued)

OTHER PUBLICATIONS

Pages from www.HairCuttingCapes.com, available, on information and belief, at least as early as Jan. 21, 2010 (2 pages).

(Continued)

*Primary Examiner* — Amy Vanatta
(74) *Attorney, Agent, or Firm* — Workman Nydegger

(57) ABSTRACT

A haircutting cape worn by a user that includes a front closure configuration is provided. The front closure configuration provides an unobstructed and seamless interface between the haircutting cape and the back of the user's neck. Moreover, the haircutting cape provides a barrier over substantially all of the user's body, thus effectively protecting the user from cut hair, water, and chemicals that are associated with barber and hair salon services. The haircutting cape includes a collar, a back portion, a first front portion, and a second front portion. The collar secures the haircutting cape to the user's neck, while the back portion covers the back of the user, and the first and second front portions cover the front of the user.

18 Claims, 6 Drawing Sheets

U.S. PATENT DOCUMENTS

| | | | | | |
|---|---|---|---|---|---|
| 4,797,953 | A | * | 1/1989 | Dameron | 2/104 |
| D314,078 | S | * | 1/1991 | Wiederhold et al. | D2/823 |
| 4,995,116 | A | * | 2/1991 | Beauchamp et al. | 2/104 |
| 6,003,155 | A | * | 12/1999 | Silberman | 2/69.5 |
| 6,496,985 | B1 | * | 12/2002 | Faldet | 2/50 |
| 7,444,684 | B1 | | 11/2008 | Medina | |
| D595,031 | S | * | 6/2009 | Buono | D2/861 |
| D627,952 | S | * | 11/2010 | Bish | D2/860 |
| 7,895,668 | B2 | * | 3/2011 | Tinecheff | 2/104 |
| 2004/0199973 | A1 | * | 10/2004 | Moyal et al. | 2/50 |
| 2010/0100996 | A1 | | 4/2010 | Zitscher | |

FOREIGN PATENT DOCUMENTS

| | | | | |
|---|---|---|---|---|
| GB | 2220557 | A | * | 1/1990 |
| JP | 10165227 | A | | 6/1998 |
| JP | 10165227 | A1 | | 6/1998 |
| JP | 2003079428 | A | | 3/2003 |
| JP | 2004183182 | A | | 7/2004 |

OTHER PUBLICATIONS

Brochure entitled "U NEED IT Beauty Supply" available, on information and belief, at least as early as Jan. 22, 2010 (2 pages).

Photographs of hair cutting cape, available, on information and belief, at least as early as Sep. 2008 (8 photos, 8 pages).

Notice of Allowance dated Jun. 25, 2010 from U.S. Appl. No. 29/355,699.

U.S. Design U.S. Appl. No. 29/355,699, filed Feb. 12, 2010, 9 pages (filing receipt, drawings and specification).

* cited by examiner

HAIRCUTTING CAPE WITH FRONT CLOSURE

CROSS-REFERENCE TO RELATED APPLICATION

This patent application claims priority to and benefit of U.S. Provisional Patent Application Ser. No. 61/152,620, filed Feb. 13, 2009 entitled CLEAN CUT CAPES to Charity Bish, which is incorporated herein, in its entirety, by reference.

BACKGROUND OF THE INVENTION

1. The Field of the Invention

The present disclosure relates to haircutting capes. More particularly, this disclosure relates to a haircutting cape worn by a user during a haircutting or hairstyling procedure.

2. The Relevant Technology

Haircutting capes are typically employed in barbershops or hair salons to protect a user and a user's clothing from cut hair, water, and/or chemicals used during the cutting, washing, and/or styling of hair. For instance, conventional haircutting capes provide a barrier that is meant to cover the user's body when the user is sitting in a chair. Due to the barrier provided by conventional haircutting capes, a barber or hairstylist can cut, wash, and/or style the user's hair while protecting the user's body and clothing from contact with cut hair, water, or chemicals. Thus, the haircutting cape may allow the user to have a more relaxed and comfortable experience while at the barber or hair salon, as well as allow the user to leave the barber or hair salon with minimal amounts of cut hair, water, or chemicals on their clothing.

Conventional haircutting capes may be configured to be worn around a user's neck. To secure conventional haircutting capes around the user's neck, conventional haircutting capes may have a configuration that wraps around the front of the user's neck and connects to itself near the back of the user's neck. For example, a barber or hairstylist may secure the haircutting cape around the user's neck by tying, tucking, or otherwise connecting the haircutting cape at the back of the user's neck.

This conventional configuration, with the collar connecting near the back of a user's neck, may present several disadvantages. One example disadvantage is that a barber or hairstylist must tie, tuck, or otherwise connect the haircutting cape at the back of the user's neck. Due to the connection of the haircutting cape at the back of the user's neck, access to the user's neckline is often obstructed, causing difficulty for the barber or hairstylist to cut or color hair close to the neckline. In some circumstances, the collar on conventional haircutting capes must be undone and moved so that the barber or hairstylist can access the user's neckline, thus causing cut hair, water, or chemicals to fall onto the user's clothing.

In addition to obstructing access to the user's neckline, conventional haircutting capes may include a cape opening that does not provide complete coverage of the user's clothing. In particular, because of the typical configuration discussed above, many conventional haircutting capes have an opening that exposes the user's back when the user is wearing the cape. Due to the fact that the collar connects in the back, the opening in the cape is over the user's back, which does not allow the cape to properly overlap and adequately cover the user. Therefore, conventional haircutting capes may not adequately protect the user from cut hair, water, or chemicals that are part of the hair styling process.

BRIEF SUMMARY OF THE INVENTION

A haircutting cape of the present invention includes a front closure configuration. The front closure configuration provides an unobstructed and seamless interface between the haircutting cape and the back of the user's neck. Moreover, the haircutting cape provides a barrier over substantially all of the user's body, thus effectively protecting the user from cut hair, water, and chemicals that are associated with barber and hair salon services.

In one implementation, the haircutting cape includes a flaccid, i.e., non-rigid, substantially rectangular sheet of material having a slit that extends from one edge of the substantially rectangular sheet of material to a collar that is positioned within the substantially rectangular sheet of material. The substantially rectangular sheet of material further includes a back portion, a first front portion, and second front portion. The first and second front portions have a longer length than the back portion. The back portion is configured to cover the back of the user, while the first and second front portions are configured to overlap one another and cover the front of the user. The collar can include various attachment elements that are used to secure the collar around the neck of the user while the user is wearing the haircutting cape.

In another example implementation, a haircutting cape is configured to be worn around the neck of a user and close over the front of the user. The haircutting cape includes a substantially rectangular sheet of material with a circular collar formed therein. The haircutting cape further includes a slit that extends between the collar and an edge of the substantially rectangular sheet of material. The slit is positioned within the haircutting cape such that the slit is configured to close over the front of the user.

In a further implementation, a method for using a haircutting cape is provided. The method includes providing a haircutting cape with a front closure configuration, wrapping the collar around the back of a user's neck, and attaching the collar proximate to the front of the user's neck.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific implementations thereof which are illustrated in the appended drawings. It is appreciated that these drawings depict only illustrated implementations of the invention and are therefore not to be considered limiting of its scope. The invention will be described and explained with additional specificity and detail through the use of the accompanying drawings in which.

DETAILED DESCRIPTION OF THE PREFERRED IMPLEMENTATIONS

A haircutting cape of the present invention includes a front closure configuration. The front closure configuration provides an unobstructed and seamless interface between the haircutting cape and the back of the user's neck. Moreover, the haircutting cape provides a barrier over substantially all of the user's body, thus effectively protecting the user from cut hair, water, and chemicals that are associated with barber and hair salon services.

Figure 1:
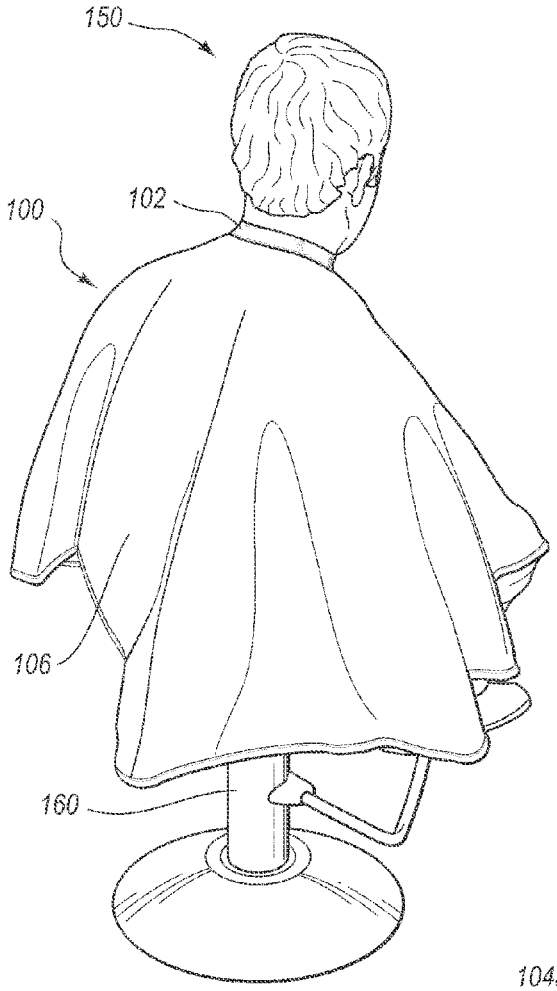
FIG. 1 illustrates back view of a user wearing an example haircutting cape.

FIG. 1 illustrates an example haircutting cape 100 that is worn by a user 150 that is sitting in a chair 160. In order to provide an effective barrier to protect the user 150 and the user's 150 clothing, the haircutting cape 100 can be made from a variety of materials. In one example implementation, the material of the haircutting cape 100 is a blend of polyester and polyurethane. In particular, in one implementation, the haircutting cape 100 material is about 76% polyester and about 24% polyurethane. In other implementations, the ratio of polyester and polyurethane vary depending on the overall desired look and feel of the haircutting cape 100.

The polyester and polyurethane blend material provides a water proof barrier that does not allow water or other chemicals to pass through the material. Moreover, because of the blend of polyester and polyurethane, the haircutting cape 100 material is not damaged by most chemicals that are used in the hairstyling process. For example, the polyester and polyurethane material is not stained or compromised by coloring chemicals, bleach, developers, neutralizers, permanent solutions, or most any other styling product used in the hairstyling process.

While the polyester and polyurethane blend of material provides an effective barrier, the material is also light weight such that the haircutting cape 100 has a comfortable fit on the user 150, as illustrated in FIG. 1. In addition, in one example implementation, the material on the top portion of the haircutting cape 100 is a slick material that has a low coefficient of friction. The slick material allows cut hair to slide off of the haircutting cape 100 so that cut hair is less likely to stick to the haircutting cape. The slick material allows the haircutting cape 100 the potential to be used several times before needing to be washed. However, when the haircutting cape 100 needs to be washed, the polyester and polyurethane blend of material is washable such that a barber or hairstylist can wash the haircutting cape 100 to remove any cut hair or styling product.

Depending on the particular use of the haircutting cape 100, other example materials can be used to make the haircutting cape. For example, the haircutting cape materials can include, but are not limited to, one or more of the following flaccid, i.e., non-rigid, materials: cotton, canvas, polyester, nylon, polyurethane, fabric, cloth, synthetic fabrics, plastic-type materials, treated fabrics, and/or any other material or fabric that provides a suitable barrier for a particular need. For example, a barber that only cuts hair (e.g., the barber does not use chemical products or provide a shampoo service) may not require a water-proof material, and therefore, the haircutting cape can be made from 100% polyester to provide an effective barrier against the cut hair.

Figure 2:
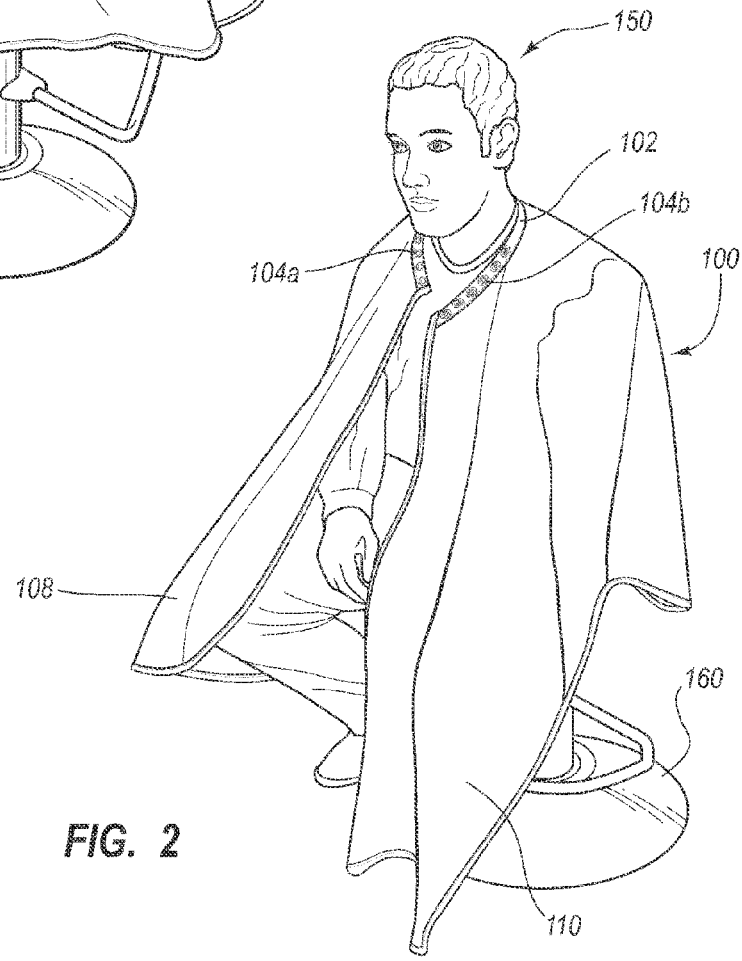
FIG. 2 illustrates a front view of a user wearing an example haircutting cape in an open position.
Figure 3:
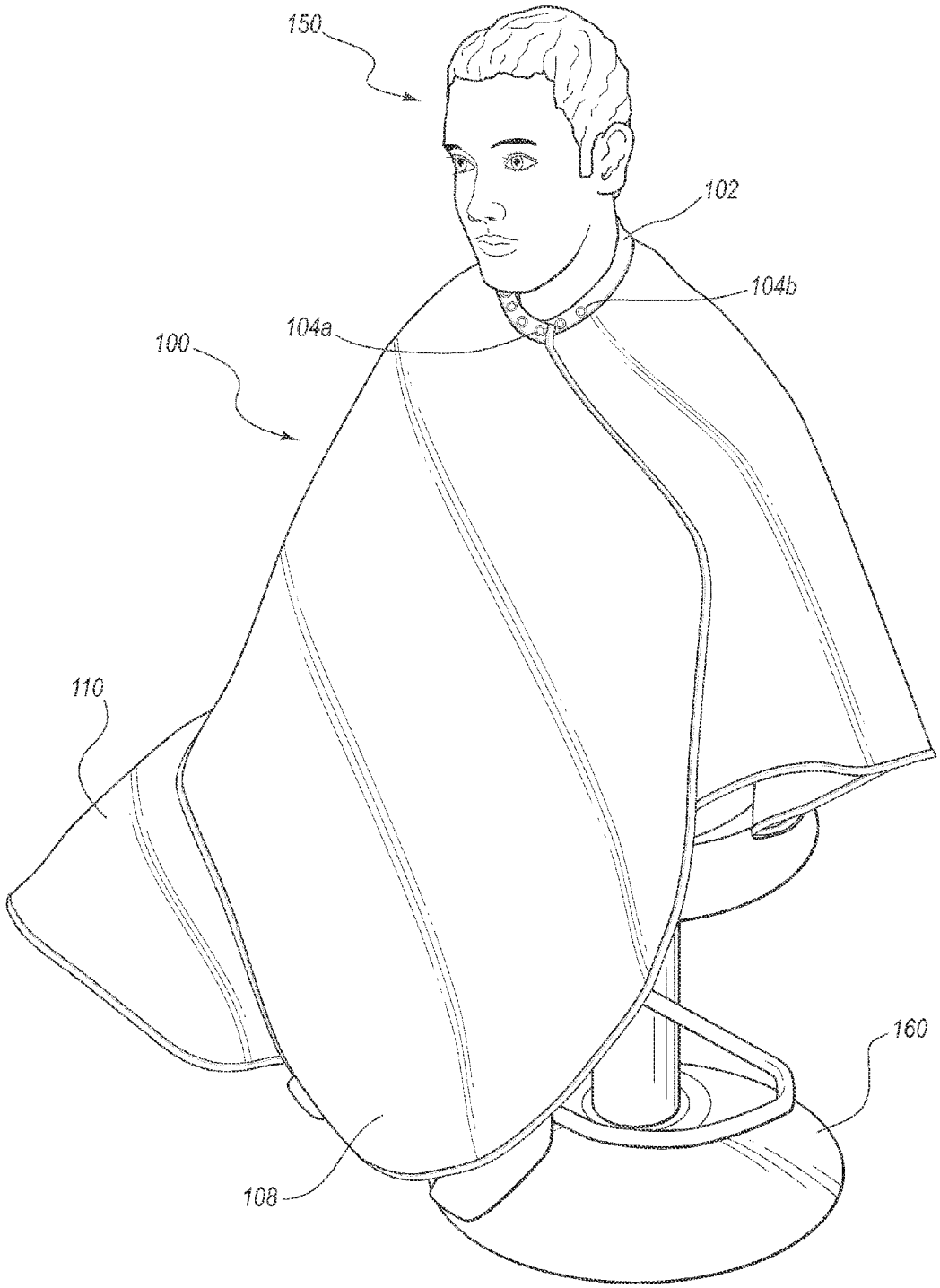
FIG. 3 illustrates a front view of a user wearing an example haircutting cape in a closed position.

Notwithstanding the haircutting cape 100 material, the haircutting cape 100 is configured to be worn around the user's 150 neck. In particular, the haircutting cape 100 includes features and characteristics such that the haircutting cape 100 closes around the user's neck substantially at the front of the user's 150 neck, and therefore provides a seamless back interface, as illustrated in FIGS. 1 through 3. For example, the haircutting cape 100 includes a collar 102 that that is designed to wrap around the neck of the user 100. As illustrated in FIG. 1, the collar 102 is a seamless band of material that is configured to wrap around the user's 150 neck such that a seal is formed between the user's 150 neck and the collar 102. Therefore, the collar 102 stops, or substantially reduces, cut hair, water, or other styling product from moving between the user's 150 neck and the collar 102.

The collar 102 can be made from the same material as described above with respect to the haircutting cape 100. In one example implementation, however, the collar 102 is made from a different material than that of the haircutting cape 100 material(s). In particular, in one example implementation, the collar 102 is made from a nylon material that provides a comfortable fit around the user's 150 neck while also providing an effective seal. Other types of materials can also be used for the collar 102. Moreover, in the case that the collar 102 is a different material than that of the haircutting cape 100 material, the collar 102 can be sewn to the haircutting cape 100 using conventional sewing techniques. Other similar techniques, such as gluing, can be used to secure the collar 102 to the haircutting cape 100.

In yet a further implementation, the collar 102 is merely an edge portion of material adjacent a hole in the haircutting cape 100 that is configured to fit about the user's 150 neck. Thus, the term "collar" may refer to an edge portion of material adjacent an aperture 112 that fits about a user's neck and/or a piece of material connected to an edge portion of material adjacent an aperture 112 that fits about a user's neck while the haircutting cape 100 is being worn by the user 150.

Just as the collar 102 material can vary, so too can the size of the collar 102. For example, in one implementation, the collar 102 has a width of about ¾" and a length of about 24". In other example implementations, the collar 102 can have a narrower or wider width, and/or a longer or shorter length depending on the overall configuration of the collar 102.

As shown in FIG. 2, the collar 102 includes attachment elements 104*a* and 104*b* such that the collar 102 can close around the user's 150 neck. As illustrated, the attachment elements 104*a* and 104*b* are positioned such that the collar 102 closes near the front neck of the user 150. Because the collar 102 closes near the front neck of the user 150, the collar 102 provides a seamless interface between the back of the user's 150 neck and the collar 102, as illustrated in FIG. 1. The seamless interface provided by the collar 102 provides the barber or hairstylist with unobstructed access to the back of the user's neck, as discussed above.

The attachment elements 104*a* and 104*b* can vary from one implementation to the next. In one example implementation, the attachment elements 104*a* and 104*b* are mating snap fasteners. In particular, attachment elements 104*a* are female snap fasteners that are configured to couple to attachment elements 104*b*, which are male snap fasteners. In other implementations, the attachment elements 104*a* and 104*b* can be other elements configured to couple or connect the collar 102 to itself around the neck of the user 150. For example, in alternative implementations, the attachment elements 104*a* and 104*b* can be VELCRO fasteners, ties, buttons, magnets, buckles, or any other similar fastening devices.

Despite the type of attachment elements 104*a* and 104*b* employed, the attachment elements can be positioned and configured to provide a collar 102 that is adjustable around a user's neck. For example, the attachment elements 104*a* and 104*b* call allow the collar 102 to close in a number of different positions such that the collar 102 can be configured to fit any number of different neck sizes. For instance, FIGS. 2 and 3 illustrate one example implementation where the attachment elements 104*a* and 104*b* include six female snap fasteners that correspond with six male snap fasteners. In this way, a single female snap fastener can connect with a possible six male snap fasteners, thus providing six different collar 102 sizes using a single female snap fastener. Because FIGS. 2 and 3 illustrate a total of six female snap fasteners and six male snap fasteners, the total number of possible collar 102 sizes is increased to provide a large degree of collar 102 adjustability around the user's 150 neck. In other implementations, there can be more or less female and/or male snap fasteners.

Just as the number of attachment elements 104*a* and 104*b* can vary, the distance between each attachment element 104*a* and 104*b* can also vary. For example, FIG. 2 illustrates an example implementation where the individual female snap fasteners are positioned about 1" apart from one another. In other implementations, the distance between the attachment elements 104*a* and 104*b* can be larger or smaller depending on the degree of desired adjustability, and the type of attachment element employed.

As discussed above, the collar 102 secures the haircutting cape 100 to the user 150. Notwithstanding the various collar 102 configurations, the haircutting cape 100 further includes various portions that effectively provide a barrier between the user 150 and the hairstyling process. In particular, FIG. 1 illustrates one example of a back portion 106 that is configured to cover the shoulders and back of the user 150. Since the collar 102 is configured to close in the front, the back portion 106 does not have an opening. Thus, the back portion 106 is a single piece of material that more effectively creates a barrier compared to conventional configurations of haircutting capes.

In addition to the back portion, the haircutting cape 100 further includes a first front portion 108 and a second front portion 110, as illustrated in FIGS. 2 and 3. In particular, the first front portion 108 and the second front portion 110 are configured to cover the front body of the user 150. FIG. 2 illustrates the haircutting cape 100 when the first front portion 108 and the second front portion 110 are in an open position. FIG. 3 illustrates the haircutting cape 100 when the first front portion 108 and the second front portion 110 are in a closed position.

As shown in FIG. 3, the first front portion 108 and the second front portion 110 can be overlapped one on top of the other such that substantially the entire front portion of the user's body is covered with the haircutting cape 100. For example, and as illustrated in FIG. 3, the first front portion 108 overlaps and rests upon the second front portion 110. Due to the dimensions and general configuration, which will be discussed in more detail below, the first front portion 108 and the second front portion 110 provide an overlapping interface such that no opening is available for cut hair, water, or other hairstyle products to reach the user or the user's clothing.

In addition to providing a substantially overlapping interface, the dimensions and general configuration of the first front portion 108 and second front portion 110 allow gravity to hold the first front portion 108 and second front portion 110 in place. In other words, the first front portion 108 and second front portion 110 do not require a friction force between any surface to hold their respective positions, as shown in FIG. 3; rather, the configuration of the first front portion 108 and the second front portion 110 are held in place simply by folding the portions over the user's 150 body and allowing gravity to hold them in place. In an alternative implementation, the haircutting cape 100 can further include additional attachment elements located on the first front portion 108 and the second front portion 110 such that the first front portion 108 and the second front portion 110 are actually attached together by one or more attachment elements when in the closed position.

Figure 4:
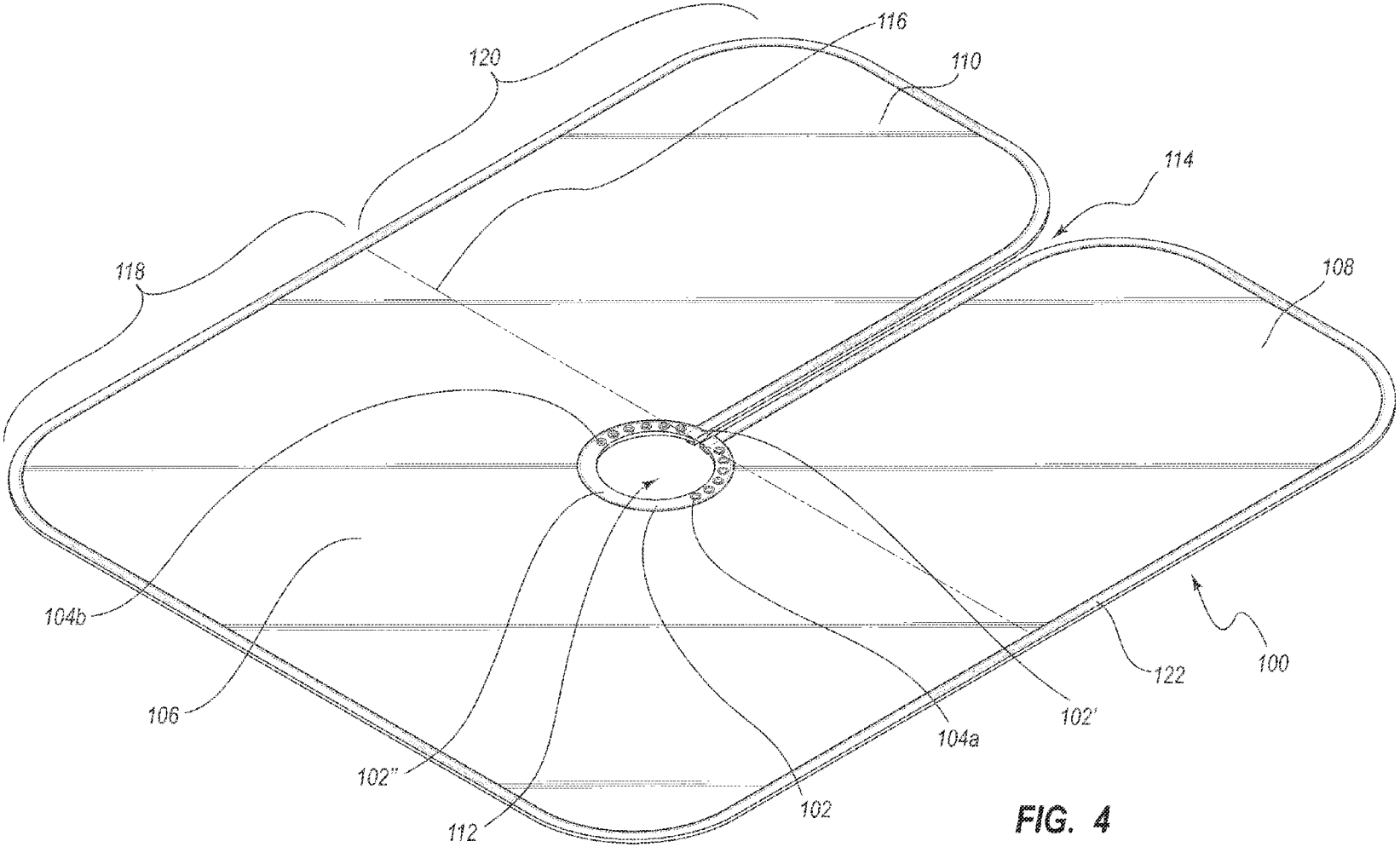
FIG. 4 illustrates a front perspective view of a haircutting cape.

As mentioned above, the dimensions and configuration of the haircutting cape 100 will be explained further with reference to FIGS. 4 through 7. FIG. 4 illustrates a perspective view of top side of the haircutting cape 100 that is positioned on a flat surface in order to illustrate additional features and characteristics. As illustrated in FIG. 4, the haircutting cape 100 has an overall configuration that is substantially rectangular. In other implementations, the haircutting cape 100 can have other overall configurations, such as circular, oval, square, diamond, or any other overall configuration that provides effective coverage of the user when the user is wearing the haircutting cape 100.

Figure 6:
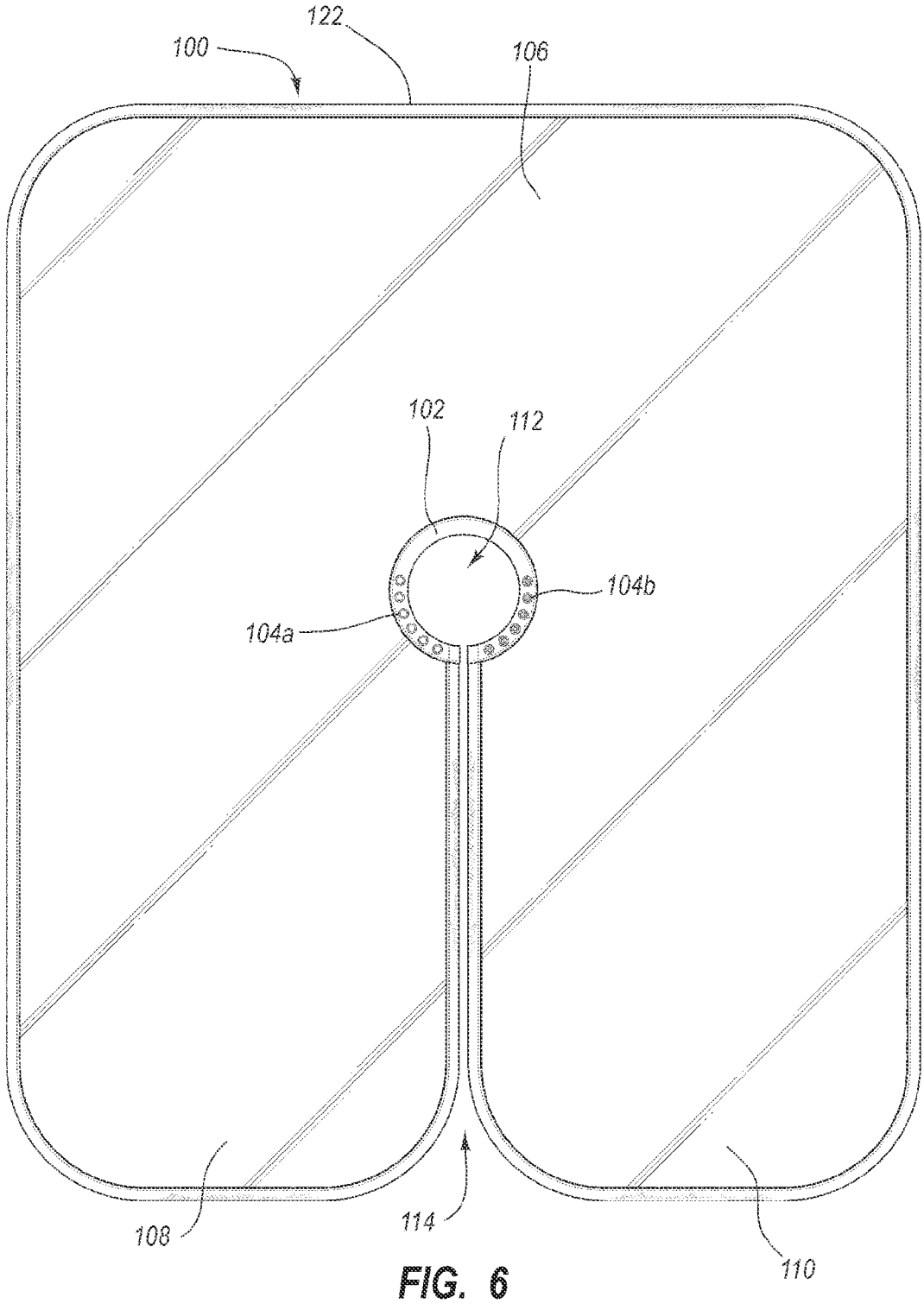
FIG. 6 illustrates a front plan view of a haircutting cape.

The haircutting cape 100 illustrated in FIG. 4 shows that the haircutting cape 100 can be considered as having a back segment 118 and a front segment 120, as shown with reference line 116. In particular, the front segment 120 includes the first front portion 108 and the second front portion 110 and extends from the bottom edge of the first front portion 108 and second front portion 110 to the edge of the slit 114 that is contiguous with the aperture 112, as illustrated in FIGS. 4 and 6. The back segment 118 includes the remaining portion of the haircutting cape 100.

The dimensional relationship between the front segment 118 and the back segment 120 can vary from one implementation to the next. For example, in one implementation the back segment 118 is about 31" in length and the front segment is about 33" in length to give a total length of about 64". However, in alternative implementations, the back segment 118 may have a different length ratio to the front segment 120. Moreover, the back segment 118 is not necessarily shorter than the front segment 120, and in alternative implementations the back segment 118 can be longer than the front segment 120. Furthermore, in one implementation, the front segment 120 and the back segment 118 may have equal lengths.

Notwithstanding the length of the back segment 118 and the front segment 120, the width of the haircutting cape 100 can also vary from one implementation to the next. For example, in one implementation the haircutting cape 100 has an overall width of about 48", with the first front portion 108 and the second front portion 119 each having a width of about 24". In alternative implementations, the overall width of the haircutting cape 100 can be wider or narrower. Moreover, it is not necessary that the first front portion 108 and the second front portion 110 have equal widths; rather, in at least some implementations the first front portion 108 and the second front portion 110 have different widths.

In addition to variations in the length and width of the haircutting cape 100, the size of the collar 102 can vary from one implementation to the next. As illustrated in FIG. 4, when the haircutting cape 100 is positioned in a flat position, the collar 102 forms a circular aperture 112 within the haircutting cape 100. In one example implementation, the aperture 112 has an inner diameter of about 6". In other implementations, however, the inside diameter of the aperture 112 can be larger or smaller depending on the overall configuration of the collar. Moreover, the aperture 112 does not have to be circular; rather, the aperture 112 can have various other configurations.

Moreover, FIG. 4 further illustrates that the collar 102 includes a front collar portion 102' and a back collar portion 102". The front collar portion 102' is located on the part of the collar 102 that is adjacent to the slit 114, as illustrated in FIG. 4. The back collar portion 102", on the other hand, is located on the part of the collar that is directly opposite of the first collar portion 102'.

The haircutting cape 100 illustrated in FIG. 4 further includes an outer hem 122 that borders the outside edge of the haircutting cape 100. In one implementation, the outer hem 122 is made from a different material than the material of the haircutting cape 100. In one example, the outer hem 122 is a nylon material. In other implementations, the outer hem 122 can be made from the same material as the haircutting cape 100 and simply be a hemmed edge that prevents fraying of the haircutting cape 100 material.

Figure 5:
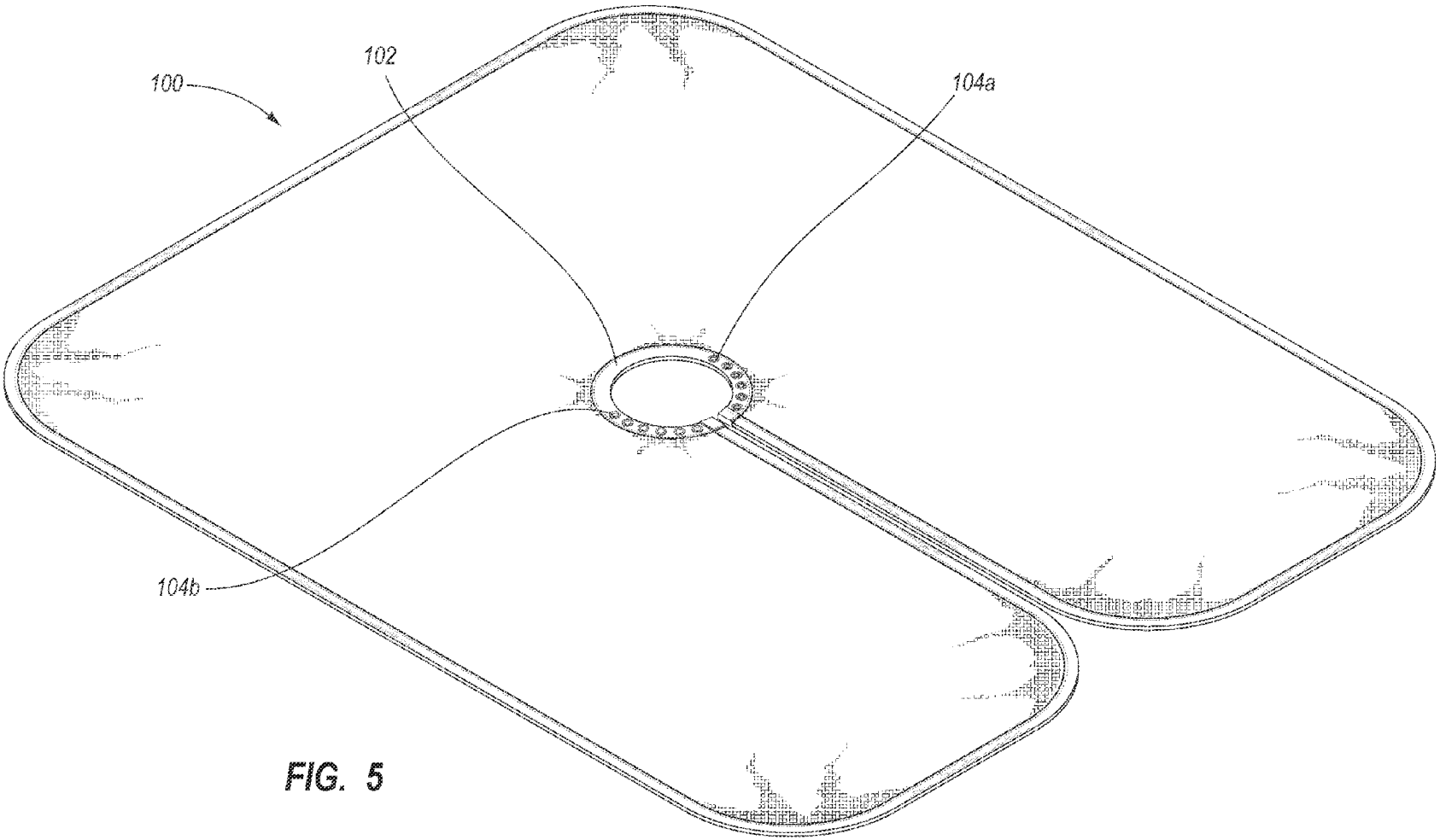
FIG. 5 illustrates a back perspective view of a haircutting cape.

FIG. 5 illustrates a perspective view of the bottom side of the haircutting cape 100. FIG. 5 further illustrates the attachment elements 104*a* and 104*b*. In particular, FIG. 5 shows that the attachment elements 104*a* and 104*b* can include female and male snap fasteners that can couple together to hold the collar 102, and the haircutting cape 100, a closed position around the neck of the user 150.

Figure 7:
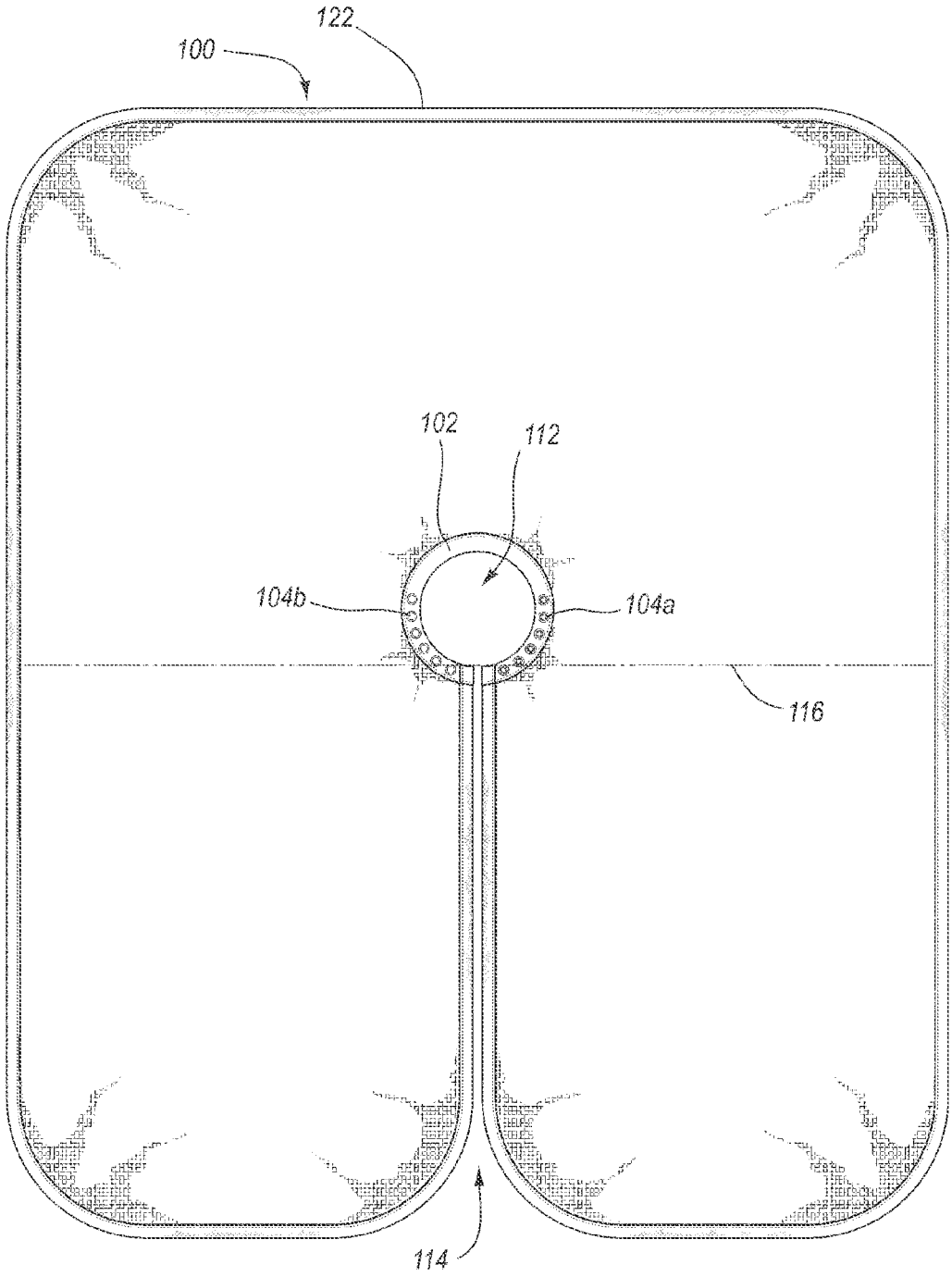
FIG. 7 illustrates a back plan view of a haircutting cape.

FIGS. 6 and 7 illustrate a plane view of the top side and bottom side of the haircutting cape 100, respectively. In particular, FIG. 6 illustrates that the top side of the haircutting cape 100 can be made from a slick material that allows cut hair to slide off of the haircutting cape 100. FIG. 7, on the other hand, illustrates that the bottom side of the haircutting cape 100 can be a softer material designed to give a comfortable feel to the user 150.

The present invention may be embodied in other specific forms without departing from its spirit or essential characteristics. The described implementations are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A haircutting cape, comprising:

a flaccid, substantially flat, substantially rectangular sheet of material that is sufficiently large to substantially cover the shoulders and torso of a person during a haircutting procedure, the sheet of material comprising:

a back portion having an aperture configured to receive the neck of a person therethrough; and first and second front portions extending from the back portion and separated by a slit, the slit being contiguous with the aperture, the first and second front portions having a length that is greater than a length of the back portion, the first front portion being configured to be folded over the second front portion while the cape is mounted on the torso of a person during a haircutting procedure; and attachment elements coupled to opposing sides of the substantially rectangular sheet of material and configured such that the attachment elements can secure the substantially rectangular sheet of material around the person's neck, wherein when the substantially rectangular sheet of material is secured around the person's neck, the first and second front portions overlap over the front of the person, the back portion covers the shoulders and back of the person, and the haircutting cape forms a smooth interface with the back of the person's neck, the cape comprising a waterproof material, and wherein the portion of the cape adjacent the aperture is substantially flat, so as to avoid interference with a person's neck during a haircutting procedure.

2. The haircutting cape of claim 1, further comprising a collar that is substantially circular in shape and configured to rest flat against the neck of a person during a haircutting procedure.

3. The haircutting cape of claim 1, wherein the length of the first and second front portions is about 33 inches.

4. The haircutting cape of claim 3, wherein the length of the back portion is about 31 inches.

5. The haircutting cape of claim 1, wherein the width of the substantially rectangular sheet of material is about 48 inches.

6. The haircutting cape of claim 1, wherein the attachment elements are snap fasteners.

7. The haircutting cape of claim 1, wherein the first front portion and the second front portion have approximately equal widths.

8. The haircutting cape of claim 1, further comprising a collar coupled adjacent to the aperture.

9. A haircutting cape configured to be worn around the neck of a user, the haircutting cape comprising:

a flaccid, substantially flat, substantially rectangular sheet of material having a slit that is contiguous with an aperture, wherein the slit extends from the aperture toward one edge of the substantially rectangular material, wherein the aperture and the slit are configured to close over the front of the user's body, such that a smooth interface is formed between the haircutting cape and the back of the neck of the user when the user is receiving a haircutting procedure, wherein the substantially rectangular sheet of material is sufficiently large to substantially cover the shoulders and torso of a person participating in a haircutting procedure, the sheet of material comprising first and second front portions and a back portion, the first and second front portions having a length that is greater than a length of the back portion, the first front portion being configured to be folded over the second front portion while the cape is mounted on the torso of a person during a haircutting procedure; and further comprising attachment elements adjacent the aperture and coupled to opposing sides of the substantially rectangular sheet of material and configured such that the attachment elements can secure the substantially rectangular sheet of material around the person's neck, wherein when the rectangular sheet of material is secured around the person's neck, the first and second front portions overlap over the front of the person, the back portion substantially covers the shoulders and back of the person, and the haircutting cape forms a smooth interface with the back of the person's neck, and wherein the portion of the cape adjacent the aperture is substantially flat, so as to avoid interference with a person's neck during a haircutting procedure.

10. The haircutting cape of claim 9, wherein the attachment elements comprise snap fasteners.

11. The haircutting cape of claim 10, wherein the attachment elements are positioned on the edge of the aperture.

12. The haircutting cape of claim 10, wherein the attachment elements comprise snap fasteners having a plurality of corresponding elements on opposing sides of the aperture.

13. The haircutting cape of claim 9, wherein the first front portion and the second front portion are separated by the slit.

14. The haircutting cape of claim 13, wherein the first front portion and the second front portion have approximately equal widths.

15. A method for covering a person's body during a hairstyling procedure, the method comprising:

providing a haircutting cape, comprising:

a flaccid, substantially rectangular sheet of material, comprising:

a back portion having an aperture configured to receive the neck of a person there through; and first and second front portions extending from the back portion and separated by a slit, the slit being contiguous with the aperture; and attachment elements coupled to opposing sides of the substantially rectangular sheet of material and configured such that the attachment elements can secure the substantially rectangular sheet of material around the person's neck, wherein when the rectangular sheet of material is secured around the person's neck, the first and second front portions overlap over the front of the person, the back portion covers the shoulders and back of the person, and the haircutting cape forms a smooth interface with the back of the person's neck, wherein the substantially rectangular sheet of material is sufficiently large to substantially cover the shoulders and torso of a person participating in a haircutting procedure, the sheet of material comprising first and second front portions and a back portion, the first and second front portions having a length that is greater than a length of the back portion, the first front portion being configured to be folded over the second front portion while the cape is mounted on the torso of a person during a haircutting procedure, and wherein the attachment elements are positioned adjacent the aperture and coupled to opposing sides of the substantially rectangular sheet of material and configured such that the attachment elements can secure the substantially rectangular sheet of material around the person's neck, wherein when the rectangular sheet of material is secured around the person's neck, the first and second front portions overlap over the front of the person, the back portion substantially covers the shoulders and back of the person, and the haircutting cape forms a smooth interface with the back of the person's neck, and wherein the portion of the cape adjacent the aperture is substantially flat, so as to be configured to avoid interference with a person's neck during a haircutting procedure;

placing the haircutting cape around the person's neck such that attachment elements are positioned proximate to the front of the person's neck; and attaching the attachment elements proximate to the front of the person's neck so as to avoid interference with a person's neck during a haircutting procedure.

16. The method of claim 15, further comprising overlapping a first front portion of the haircutting cape with a second front portion of the haircutting cape to cover the front body of the person.

17. The method of claim 16, further comprising styling the person's hair around a seamless interface between the haircutting cape and the back of the person's neck.

18. The method of claim 17, further comprising the step of removing the haircutting cape after styling the person's hair, comprising:

removing the first front portion from the front of the person's body; and removing the second front portion from the front of the person's body.

* * * * *